US005690298A

United States Patent [19]

Rück

[11] Patent Number: 5,690,298

[45] Date of Patent: Nov. 25, 1997

[54] POPE REEL FOR A PAPER MACHINE

[75] Inventor: Karl Rück, Heidenheim, Germany

[73] Assignee: J. M. Voith GmbH, Heidenheim, Germany

[21] Appl. No.: 594,382

[22] Filed: Jan. 30, 1996

Related U.S. Application Data

[63] Continuation of Ser. No. 295,282, Aug. 24, 1994, abandoned.

[30] Foreign Application Priority Data

Jan. 24, 1994 [DE] Germany ..... 44 01 959.9

[51] Int. Cl.[6] ..... B65H 18/26; B65H 18/16; B65H 19/22

[52] U.S. Cl. ..... 242/542.3; 242/541.6

[58] Field of Search ..... 242/541.5, 541.6, 242/542.2, 542.3

[56] References Cited

U.S. PATENT DOCUMENTS

| | | | |
|---|---|---|---|
| 1,248,542 | 12/1917 | Pope | 242/542.3 |
| 1,923,670 | 8/1933 | Henson et al. . | |
| 3,857,524 | 12/1974 | Melead et al. . | |
| 4,179,330 | 12/1979 | Page | 242/542.3 X |
| 4,475,696 | 10/1984 | Birch et al. | 242/542.2 X |
| 4,546,930 | 10/1985 | Rohde et al. | 242/542.3 X |
| 4,598,877 | 7/1986 | Oinonen | 242/541.5 |
| 4,721,266 | 1/1988 | Haapanen et al. | 242/542.3 X |
| 4,944,467 | 7/1990 | Snygg | 242/542.3 X |
| 4,979,689 | 12/1990 | Snygg | 242/542.3 |
| 5,154,367 | 10/1992 | Beisswanger | 242/542.3 X |
| 5,249,758 | 10/1993 | Muller et al. | 242/541.5 X |
| 5,251,835 | 10/1993 | Kyytsonen . | |
| 5,370,327 | 12/1994 | Adamski | 242/541.6 X |

FOREIGN PATENT DOCUMENTS

| | | |
|---|---|---|
| 483092 | 4/1992 | European Pat. Off. . |
| 4007329 | 1/1992 | Germany . |
| 4213712 | 10/1993 | Germany . |
| 1297812 | 11/1972 | United Kingdom . |

*Primary Examiner*—Daniel P. Stodola
*Assistant Examiner*—William A. Rivera
*Attorney, Agent, or Firm*—Baker & Daniels

[57] ABSTRACT

A Pope reel for winding a running paper web into a paper roll on a paper machine. The web is wound on a webwide king roll, which web wraps around the king roll on part of its circumference. A magazine holds a number of winding drums, each of which serves as a winding core. A pair of swivel levers pick up an individual winding drum and transfer it into its winding start position on the king roll. The winding drum with the paper roll being wound migrates along a guideway, and moves away from the king roll up to a delivery position for the finished paper roll. A second king roll is provided, which king roll is powered and is forceable down on the paper roll.

5 Claims, 4 Drawing Sheets

POPE REEL FOR A PAPER MACHINE

This is a continuation of application Ser. No. 08/295,282, filed Aug. 24, 1994, now abandoned.

BACKGROUND OF THE INVENTION

The invention relates to a Pope reel for winding a running paper web into a paper roll on a paper machine. A webwide king roll is provided, onto which runs the web to be wound. The web is wrapped around the king roll on part of its circumference. A magazine holds a number of winding drums, each of which serves as a winding core. A pair of swivel levers picks up an individual winding drum and transfers it into its winding start position on the king roll. A winding drum with the paper roll being wound migrates along a guideway and, in the process, moves away from the king roll up to a delivery position for the finished paper roll.

Pope reels of this general type are known from the following publications:

(1) DE 40 07 329 C2

(2) GB 12 97 812

(3) US 19 23 670

(4) EP 0 483 092 A1

Pope reels form the final group of a paper machine and serve to wind the finished paper web into a roll. A winding drum is employed as a winding core. The winding drum is arranged parallel to the king roll and rests with its journals in the forks of two swivel levers, so that the winding drum can swivel about part of the king roll circumference. Mostly, the winding drum is set on the king roll in its apex area and, in starting the web leader on the drum, is swiveled by about one quadrant of the king roll, in a direction away from the paper machine. The winding then continues on a horizontally extending rail, and the hold-down pressure is effected by a pair of levers.

To prevent defective winding, a certain winding hardness must be assured in each diameter range; it is generated by the web pull and, in large measure, by forcing the paper roll on the king roll. With large and highspeed paper machines having large winding diameters, the above options are no longer sufficient to prevent paper defects, such as wrinkles and splits in the core area of the finished paper roll, which defects are attributable to high radial squeeze with insufficient tangential tension of the paper and positional shifts resulting thereof.

To raise the winding hardness it is necessary to increase the tangential tension in the paper roll. To that end, winding drum drives are used which introduce a torque in the winding drum-so-called center drives. Such a center drive is known from the publication (4). It requires the provision of two winding drum drives, one of which is arranged on the drive side and the other on the tending side of the Pope reel. This measure safeguards the exertion of a torque on the growing paper roll during its entire migration along the guideway.

Providing two drives involves considerable construction expenditure. Problems may also arise from the exact cut-in timing of the respective drive. The problem underlying the invention is to design a Pope reel in such a way that the winding hardness has a desired progression from start to finish of the paper roll, that extreme softness in the core area as well as a sudden hardness drop in the center or outer range will be avoided, and that the winding hardness is under control at any moment of the winding process. This is meant to be accomplished without the disadvantages associated with a second center drive.

SUMMARY OF THE INVENTION

This problem is solved through the inventive features of the present invention. The invention is based on the idea of providing a further drive of the paper roll, and at that, a drive which by means of a second king roll attacks at the paper roll periphery.

The present invention, in one form thereof, comprises a Pope reel for a paper machine, for winding a running paper web into a paper roll. A webwide king roll is provided, onto which runs the web to be wound. The web wraps around the king roll on part of its circumference. A magazine holds a number of winding drums, each of which serves as a winding core. A pair of swivel levers picks up an individual winding drum and transfers it into its winding start position on the king roll. The winding drum along with the paper roll being wound migrates along a guideway, and in the process, moves away from the king roll up to a delivery position for the finished paper roll. A second king roll is provided. The second king roll is powered, and can be forced down on the paper roll.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

DETAILED DESCRIPTION OF THE INVENTION

Figure 1:
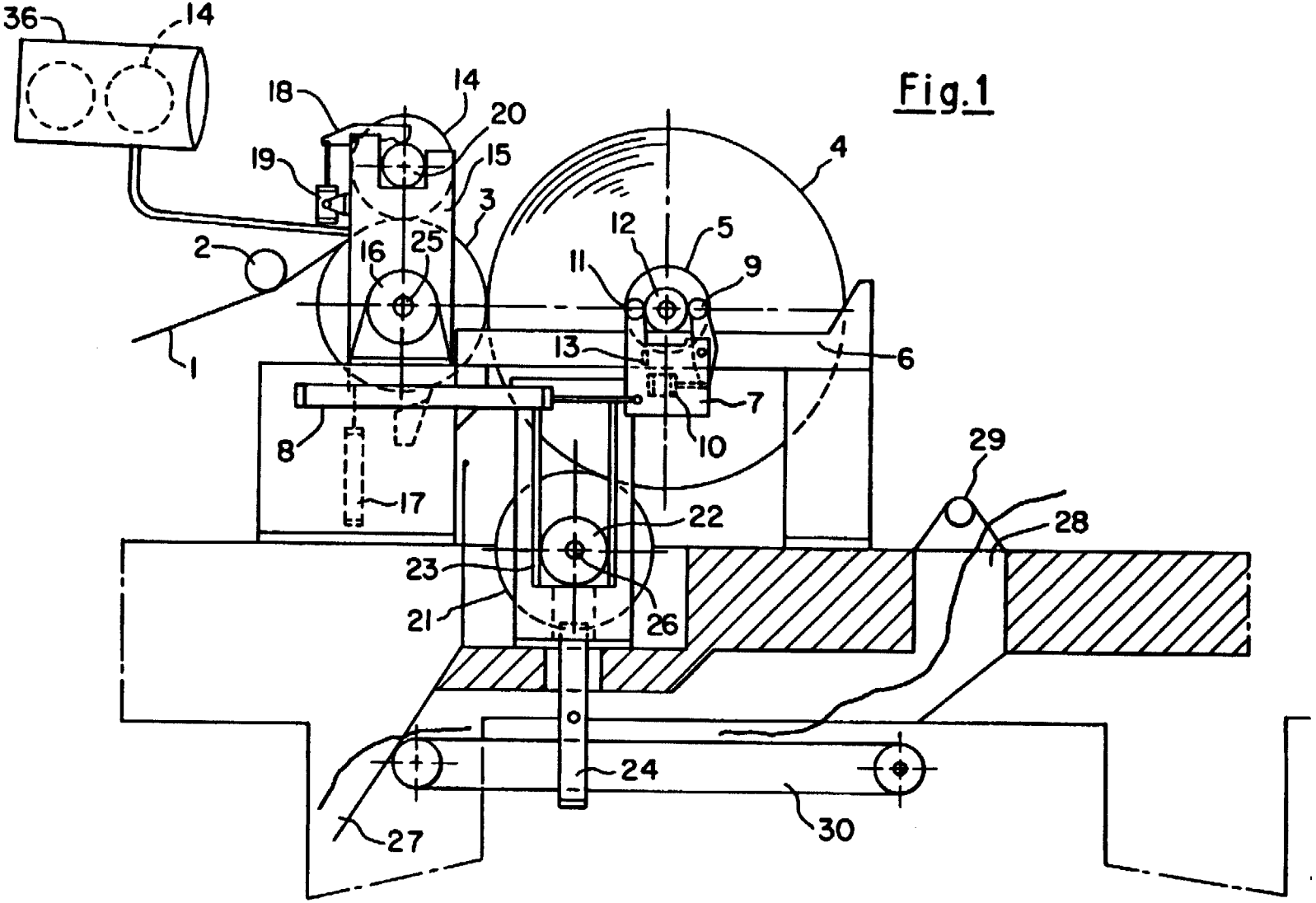
FIG. 1 shows a side elevation view of a Pope roller according to the present invention.

The paper web 1 runs over an expander drum 2 onto a king roll 3 and is wound, by means of a winding drum 5, into a paper roll 4 while the winding drum 5 runs on a horizontal guideway 6. The squeeze is effected by slides 7, which are arranged on both sides of the reel and moved by means of cylinders 8. Once a maximum winding diameter is reached, a lock lever 9 is lowered by means of a power cylinder 10, allowing the paper roll to be unloaded and the slides 7 to receive a new paper roll. During winding, the winding drum bearings 12 are securely locked between levers 9 and 11. Lever 11 swivels counterclockwise so that, when receiving a new winding drum, it can pass through beneath the winding drum bearing. A stop 13 keeps the lever from folding away under pressure.

An empty winding drum 14 rests on swivel levers 15 which, in turn, swivel about the winding drum bearing 16. The swivel levers 15 are able to swing the winding drum 14 all the way down on the guideway 6, along the king roll periphery. This is effected by a power cylinder 17. The bearings 20 of winding drum 14 are retained by means of levers 18 which, in turn, are actuated by power cylinders 19. Additional empty winding drums are stored in magazine 36.

A further king roll 21 is situated beneath the guideway 6 and runs with its bearings 22 in gibs 23. Provided on both sides of the machine are power cylinders 24 which act on the bearings 22 of the second king roll 21, forcing it on the running paper roll 4.

The drives 25, 26 of king rolls 3 and 21, respectively, allow a control such that the entire drive capacity can be distributed selectively to the two king rolls, so that one of them may in the extreme case receive zero or one hundred percent of the drive power. Similar, the entire drive capacity is selectively distributable between the two king rolls and the center drive.

Located below the Pope reel is a pulper 27. The scrap paper accruing at web breaks proceeds through an opening 28 on a conveyer belt 30. A guard 29 secures the opening.

Figure 2:
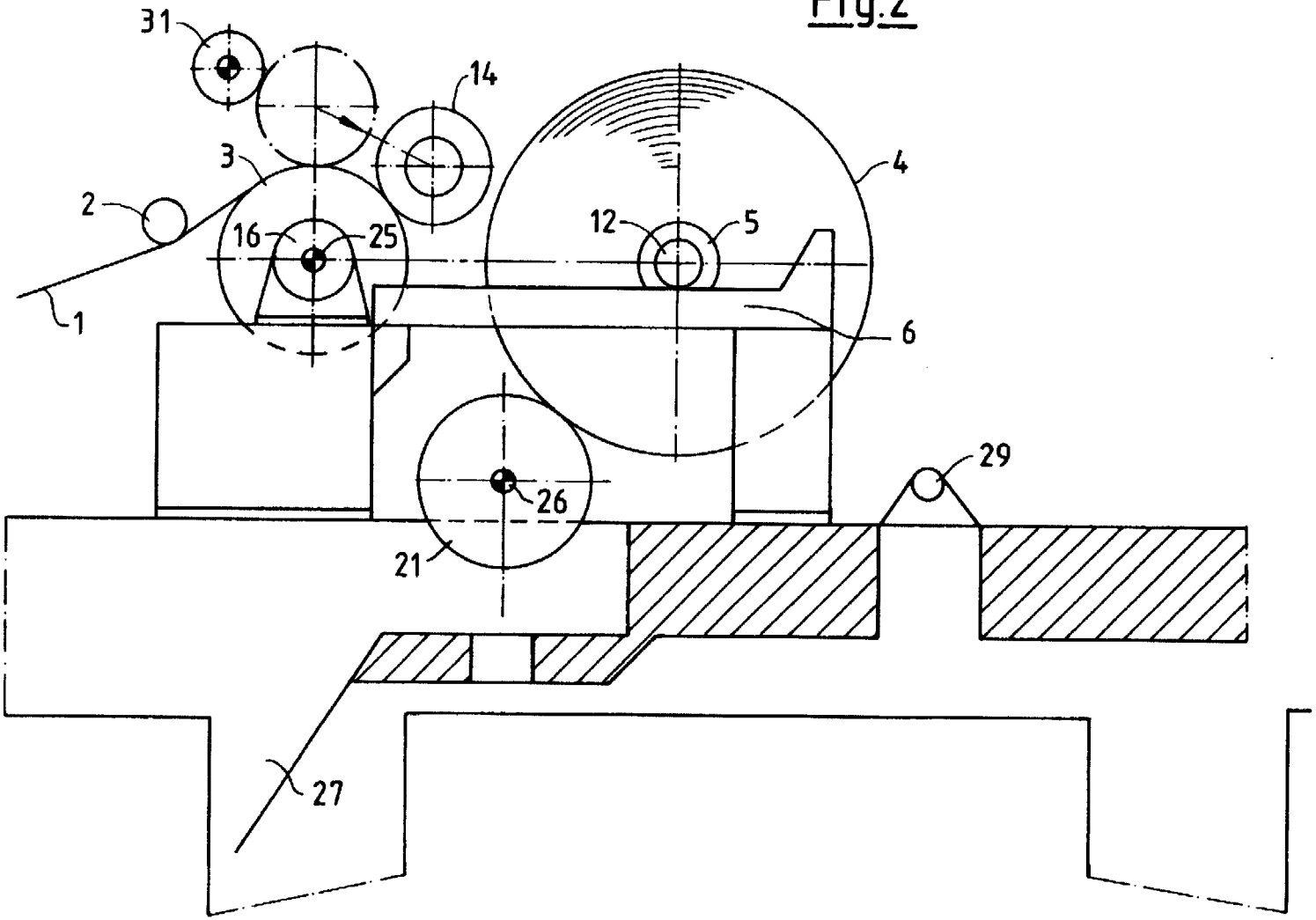
FIGS. 2 and 3 show a mode of operation of a Pope roller.
Figure 3:
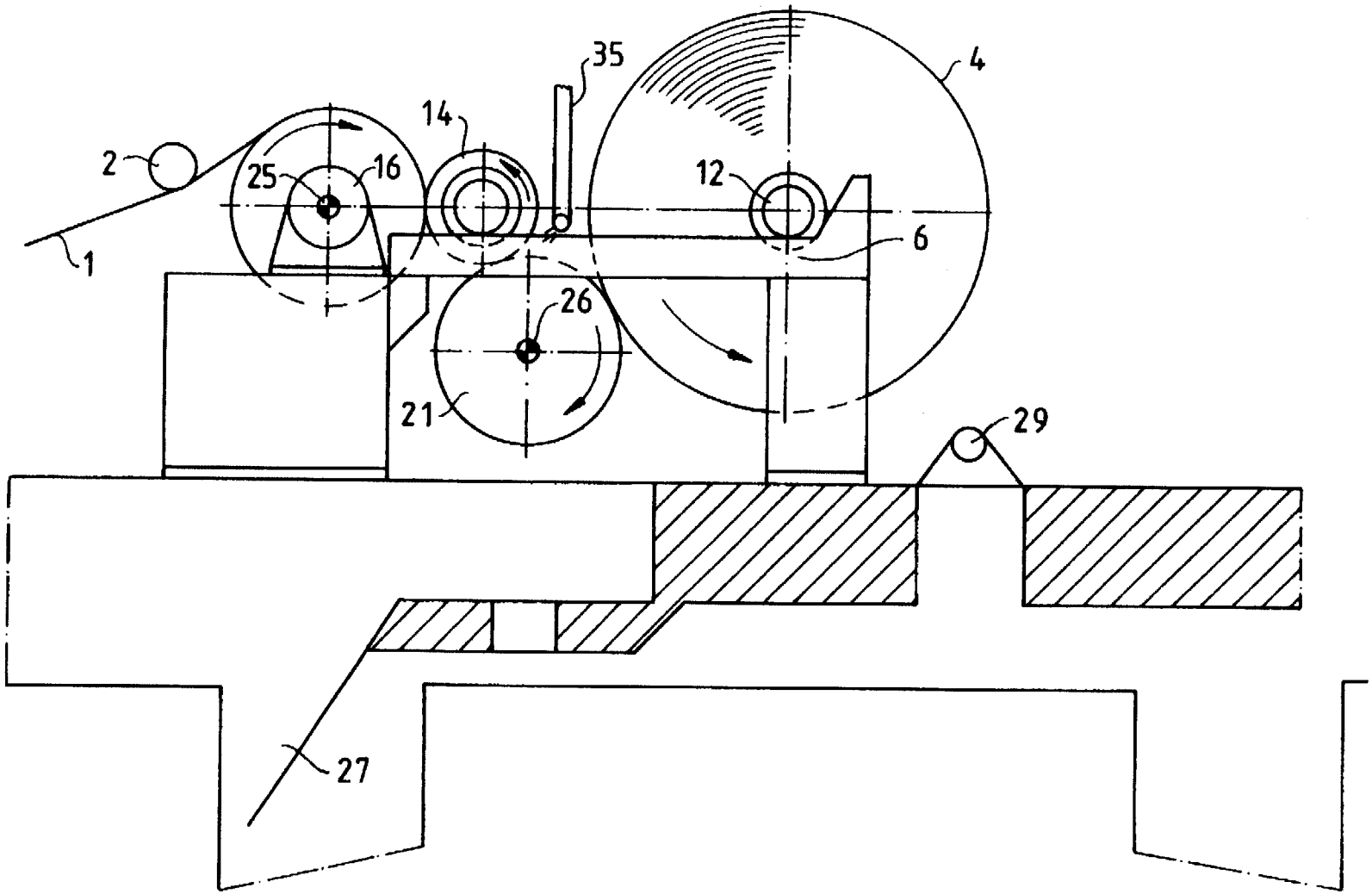
Figure 4:
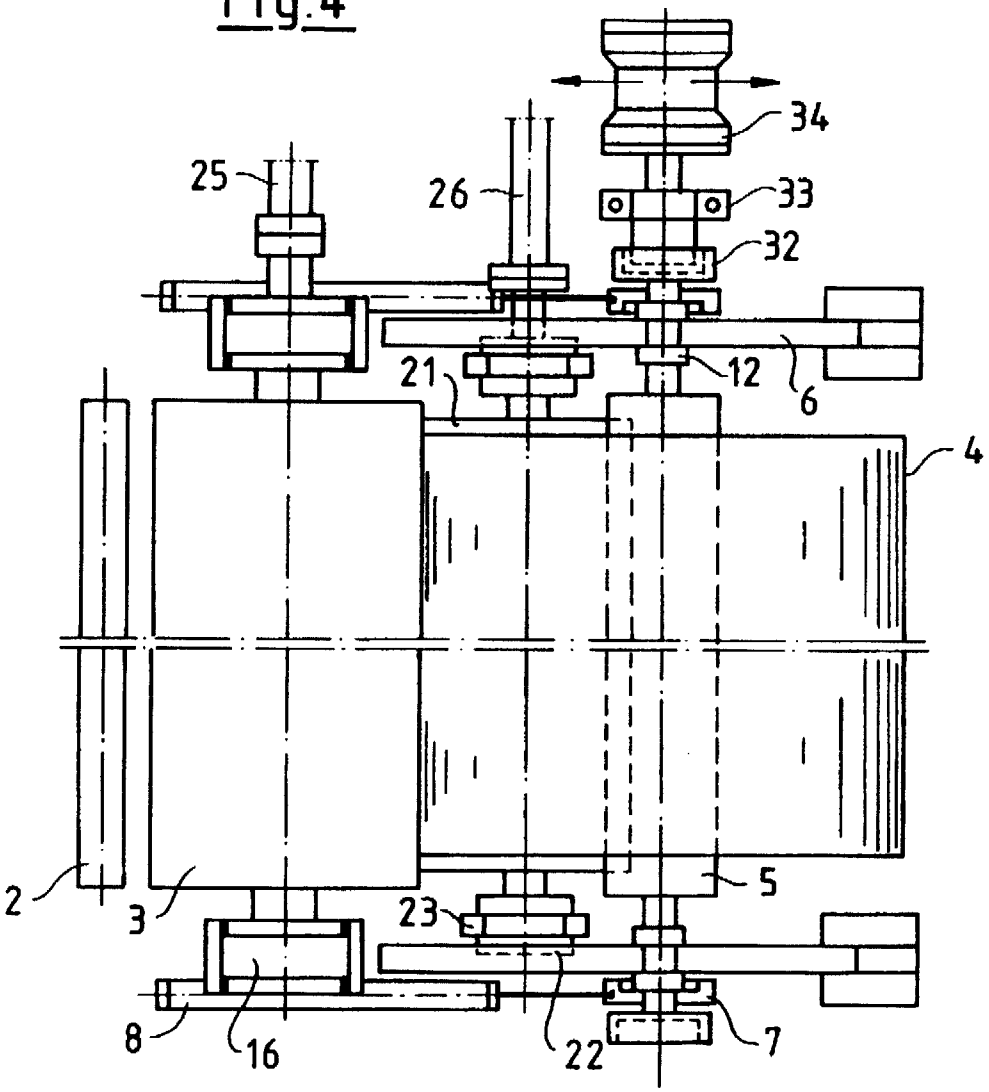
FIG. 4 shows a top plan view of the Pope roller of FIG. 1.

The mode of operation of the Pope reel can be seen best from FIG. 2 and 3. Once the maximum winding diameter has been reached—refer to FIG. 2—, the paper roll 4 is removed from king roll 3 on the guideway 6. King roll 21 follows the paper roll 4 and maintains the web pull by exerting by frictional entrainment a torque on the paper roll on its circumference. Simultaneously, the empty winding drum 14 is accelerated to the speed of the paper web 1 by an engagement device 31 and swung down on the guideway 6 by means of swivel levers 15. Meanwhile, the full winding drum 5 continues to move away while king roll 21 continues to be raised until its shell surface bears on the shell surface of the empty winding drum 14. The roll change occurs now by means of a blow pipe 35—refer to FIG. 3—or loop formation, triggered by the retraction of winding drum 5 with the paper roll 4 from king roll 21.

As needed, a center drive 37 may optionally be coordinated with the winding drum which is in operation. This is a further measure for improving the winding quality. Here, the winding drum drive disengages shortly before the paper roll 4 reaches its maximum diameter, and said drive moves into its home position in front of the king roll, to drive winding drum 14 from the start of winding.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A Pope reel for winding a running paper web into a paper roll in a paper machine, said paper machine having two sides, comprising:

a magazine for holding a plurality of empty winding drums, each of said empty winding drums serving as a winding core;

a webwide first pressing roll onto which runs the web to be wound, said web being wrappable around a portion of the circumference of the pressing roll;

a pair of swivel levers for picking up an empty winding drum and transferring the drum to a winding start position on the first pressing roll for commencement of a winding of said web onto said drum;

a guideway which supports said empty winding drum during the winding operation and along which migrates the winding drum having the paper web being wound thereon, said winding drum being movable along the guideway to a delivery position for a finished paper roll;

a slide arranged on each side of the paper machine, each of said slides being engageable with the winding drum so as to force the paper roll against the first pressing roll; and a second pressing roll, said second pressing roll being powered, and being situated generally beneath said guideway; said second pressing roll further being forceable against the paper roll;

means for forcing said second pressing roll against the paper roll; wherein said first pressing roll, second pressing roll and said paper roll are configured and juxtaposed such that each of the respective first and second pressing rolls maintains constant contact with said paper roll during substantially the entire winding of the web on the winding drum.

2. Pope reel according to claim 1, wherein the second pressing roll is movable in a vertical direction.

3. Pope reel according to claim 1, further comprising a positioning means for keeping the second pressing roll in contact with an empty winding drum during a change of paper rolls, and at the same time in contact with the paper roll.

4. Pope reel according to claim 1, further comprising a center drive coordinated with the winding drum migrating in the guideway.

5. A method for winding a running paper web into a paper roll in a Pope reel of a paper machine, comprising:

transferring an empty winding drum on which the paper web is to be wound to a winding starting position on a guideway which supports said empty winding drum during the winding operation such that the winding drum is in contact with a first pressing roll, and accelerating the winding drum to the speed of the running paper web;

raising a second pressing roll situated beneath the guideway until a shell surface of said second pressing roll bears on a shell surface of the empty winding drum;

winding the paper web onto the winding drum to form a paper roll, whereby the first and second pressing rolls exert a pressure against the paper roll during substantially the entire winding of the paper roll;

removing the paper roll from the first pressing roll to a winding end position when the maximum diameter of the paper roll is reached, said second pressing roll remaining in contact with the full paper roll maintaining the pressure against the paper roll; and transferring a new empty winding drum to the winding starting position on the guideway, and repeating said raising, winding and removing steps with said new winding drum.

* * * * *